US006805225B2

(12) United States Patent
Freedman

(10) Patent No.: US 6,805,225 B2
(45) Date of Patent: Oct. 19, 2004

(54) COMBINATION TRAVEL AND LAUNDRY BAG

(76) Inventor: Roberta Freedman, 6032 NW. 73rd Ct., Parkland, FL (US) 33067

( * ) Notice: Subject to any disclaimer, the term of this patent is extended or adjusted under 35 U.S.C. 154(b) by 0 days.

(21) Appl. No.: 10/118,151

(22) Filed: Apr. 8, 2002

(65) Prior Publication Data

US 2003/0188943 A1 Oct. 9, 2003

(51) Int. Cl.[7] ..... A45C 3/00
(52) U.S. Cl. ..... 190/112; 220/495.05
(58) Field of Search ..... 190/112, 113, 190/4, 5, 7, 13 R, 107, 108, 110, 111; 206/286; 383/12, 41, 22, 33, 104; 248/95, 98; 312/211, 212; 220/495.05–495.1

(56) References Cited

U.S. PATENT DOCUMENTS

| | | | | | |
|---|---|---|---|---|---|
| 1,604,905 | A | * | 10/1926 | Gendron | 220/495.08 |
| 3,322,477 | A | * | 5/1967 | Armijo | 312/211 |
| 3,893,615 | A | * | 7/1975 | Johnson | 232/43.2 |
| 3,977,450 | A | * | 8/1976 | Schampier | 383/7 |
| 4,218,103 | A | * | 8/1980 | Bacskay | 312/211 |
| 4,642,934 | A | * | 2/1987 | Carlson et al. | 43/55 |
| 4,923,080 | A | * | 5/1990 | Lounsbury | 220/600 |
| 5,154,266 | A | * | 10/1992 | Bieber et al. | 190/109 |
| 5,195,501 | A | * | 3/1993 | Ault | 206/579 |
| 5,288,150 | A | * | 2/1994 | Bearman | 383/38 |
| 5,472,280 | A | * | 12/1995 | Rittmaster | 383/6 |
| 5,503,476 | A | * | 4/1996 | Hamdan | 383/9 |
| 5,507,577 | A | * | 4/1996 | Fowler | 383/7 |
| 5,511,682 | A | * | 4/1996 | Pace | 280/47.26 |
| 5,593,008 | A | * | 1/1997 | Magnusson | 383/7 |
| 5,690,217 | A | * | 11/1997 | Friday | 206/278 |
| 5,749,447 | A | * | 5/1998 | Hersh et al. | 190/112 |
| 5,762,170 | A | * | 6/1998 | Shyr et al. | 190/109 |
| 5,833,336 | A | * | 11/1998 | Dean | 312/293.2 |
| 5,931,120 | A | * | 8/1999 | Burns et al. | 119/497 |
| 6,123,215 | A | * | 9/2000 | Windle | 220/495.07 |
| 6,179,151 | B1 | * | 1/2001 | Radvansky et al. | 190/112 |
| 6,386,414 | B1 | * | 5/2002 | Kilduff | 224/638 |
| 6,491,074 | B1 | * | 12/2002 | Roegner | 150/112 |
| 6,494,335 | B1 | * | 12/2002 | Kellogg et al. | 220/9.3 |
| 6,595,334 | B1 | * | 7/2003 | Saetia | 190/18 A |

FOREIGN PATENT DOCUMENTS

| | | | | |
|---|---|---|---|---|
| FR | 2777717 | * | 6/1999 | 383/6 |

OTHER PUBLICATIONS

Lamming, Pub. US 2002/38754 A1, Apr. 4, 2002.*

* cited by examiner

*Primary Examiner*—Lien M. Ngo
(74) *Attorney, Agent, or Firm*—Akerman Senterfitt

(57) ABSTRACT

A combination travel and laundry bag (10) comprises a main compartment having a substantially parallelepiped shape with a top side (16), a bottom side (20), a front side (12), a rear side (40), a left side (14), and a right side (18), a first opening that is selectively closed for providing access to the main compartment as a travel bag on at least one side selected from the group of the front side, the left side, and the right side, and an opening on the top side that is selectively closed, wherein at least a first meshed bag is selectively attached to portions of the periphery of the top side.

20 Claims, 4 Drawing Sheets

10
24
17
71
72
15
26
28
16
14
12
13
72

10
75
44
73
42
40
36
18
20

24
74
26
28

63
61

63
61
50
50
60
12
10

COMBINATION TRAVEL AND LAUNDRY BAG

FIELD OF THE INVENTION

This invention relates generally to travel bags, and more particularly to a travel bag or cart suitable for serving as a laundry basket or bag.

BACKGROUND OF THE INVENTION

Laundry bags, hampers or duffle bags are not easily transportable once filled with laundry. Conventional travel garments or devices such as suitcases or roller duffle bags are not suitable for maintaining dirty laundry such as hampers. Although suitcases and duffle bags are certainly constructed to carry clothing, they are not ideally suited to allow dirty garments to "breath". Hampers allow garments to breath through vents or holes or by having a wide opening on a top side which helps prevent the growth of mold or other odor causing bacteria.

Folding carts that are used by many to carry laundry have many of the characteristics of a hamper, but are not ideally suited to carry clothes for travel purposes. Folding carts fail to have an enclosed main compartment that would prevent clothes from falling out during transport or prevent clothes from additional accidental soiling during transport. Furthermore, access to clothes or other items in a folding cart is primarily restricted to a top opening, which makes it difficult to fold, sort or even retrieve items from the folding cart. Many folding carts may also fail to provide privacy by exposing dirty (or clean) laundry during transport.

In many living arrangements, washing machines and dryers are not necessarily close to one's residence. For instance, in large apartment buildings or college dormitories, laundry facilities could be quite some distance away on a different floor or building or even away from the vicinity of the apartment building. Thus, using a conventional laundry hamper, basket, or bag to transport even a modest load of laundry would cause a strain for many people. Using a folding cart to transport laundry might be suitable in such an instance, but an individual wishing to travel in a car, airplane or other means or transport will likely need a separate travel bag to overcome the detriments of a folding cart.

Thus, a need exists for a combined travel and laundry bag or hamper that is easily transportable, provides adequate access to garments and further provides adequate aeration to the garments. Such a bag should enable the use of the bag as a hamper and laundry basket in one mode and the use of the bag as a travel bag in a second mode without the detriments described above.

SUMMARY

In a first aspect of the present invention, a combination travel and laundry bag comprises a main compartment having a substantially parallelepiped shape with a first side that is longer and substantially orthogonal to a second side, an opening on the first side that is selectively closed for providing access to the main compartment as a travel bag, and an opening on the second side that is selectively closed, wherein at least a first meshed bag is selectively attached to portions of the periphery of the second side and wherein the first meshed bag hangs down when the second side serves as a top side of the combination travel and laundry bag.

In a second aspect of the present invention, a combination travel and laundry bag comprises a main compartment having a substantially parallelepiped shape with a top side, a bottom side, a front side, a rear side, a left side, and a right side, a first opening that is selectively closed for providing access to the main compartment as a travel bag on at least one side selected from the group of the front side, the left side, and the right side, and an opening on the top side that is selectively closed, wherein at least a first meshed bag is selectively attached to portions of the periphery of the top side.

DETAILED DESCRIPTION OF THE DRAWINGS

Figures 4, 5, 6:
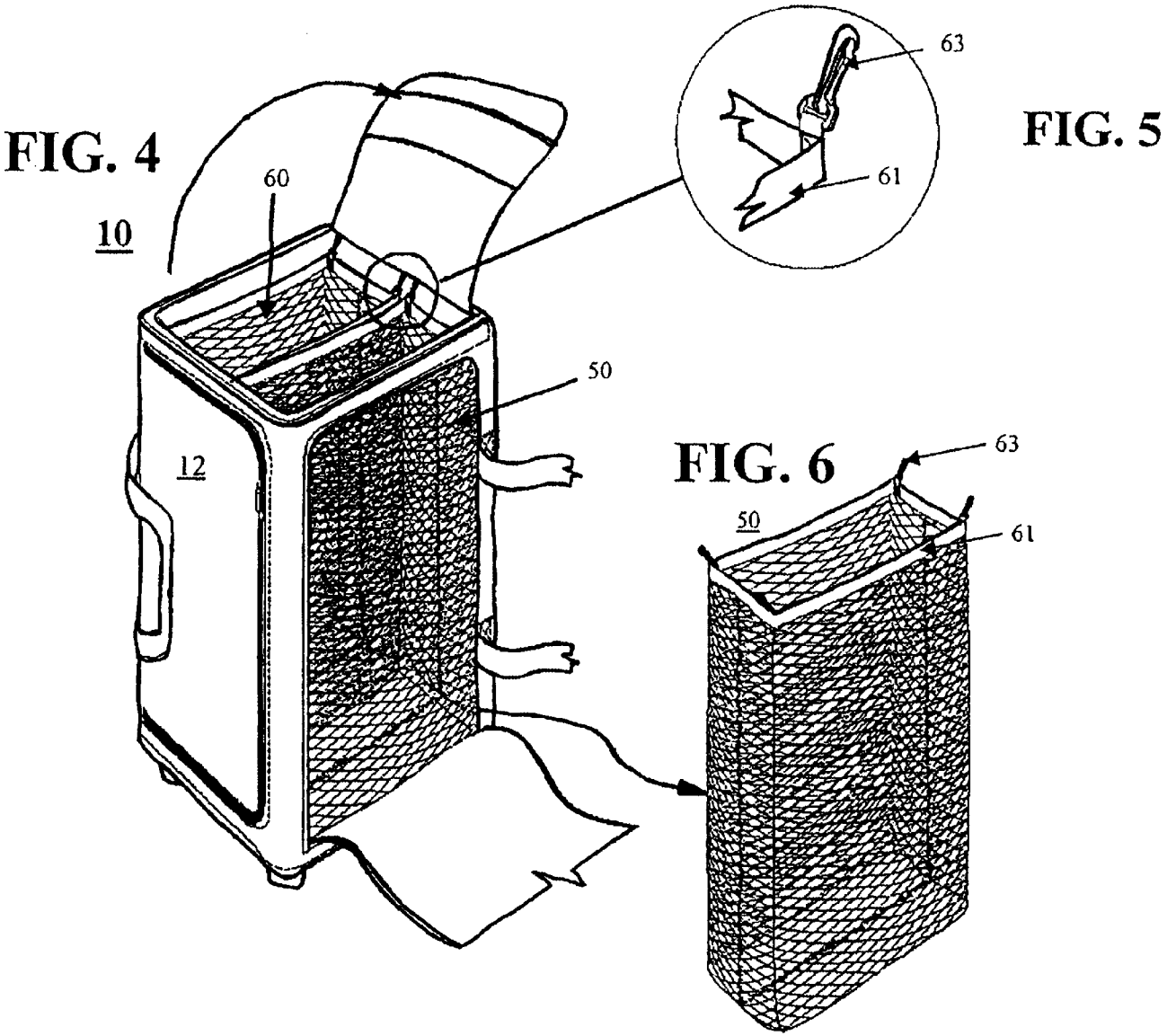
FIG. 4 is another front left perspective cut-out view illustrating meshed bags in the bag of FIG. 1 in accordance with the present invention.
FIG. 5 is a detailed view of a hook used in conjunction with the meshed bags of FIG. 4 in accordance with the present invention.
FIG. 6 is a perspective view of the meshed bag in accordance with the present invention.
Figure 8:
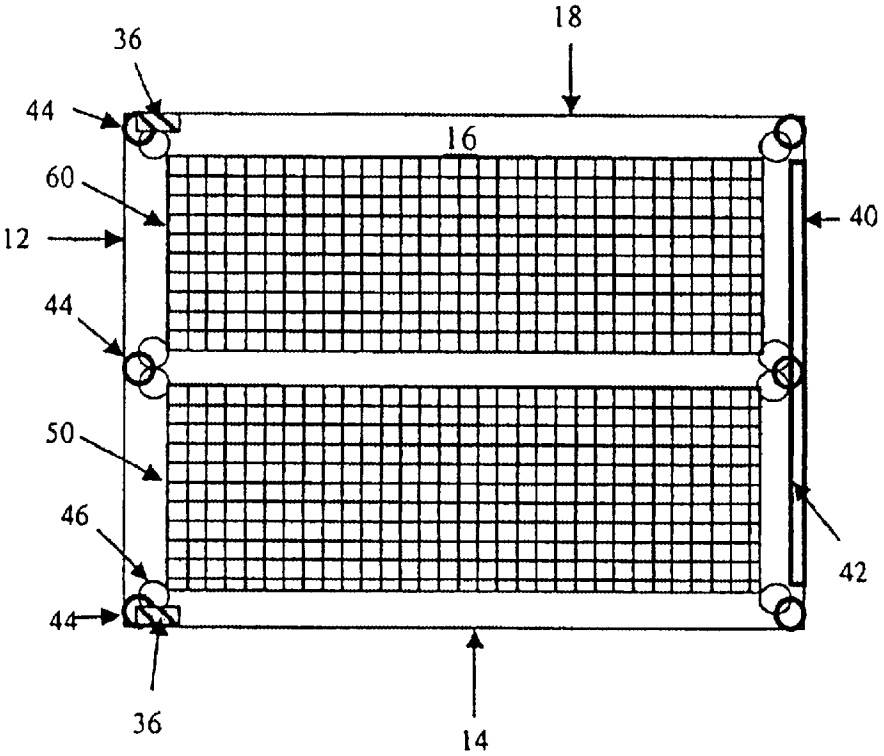
FIG. 8 is a top plan view of the top side of the bag of FIG. 4 in accordance with the present invention.
Figure 10:
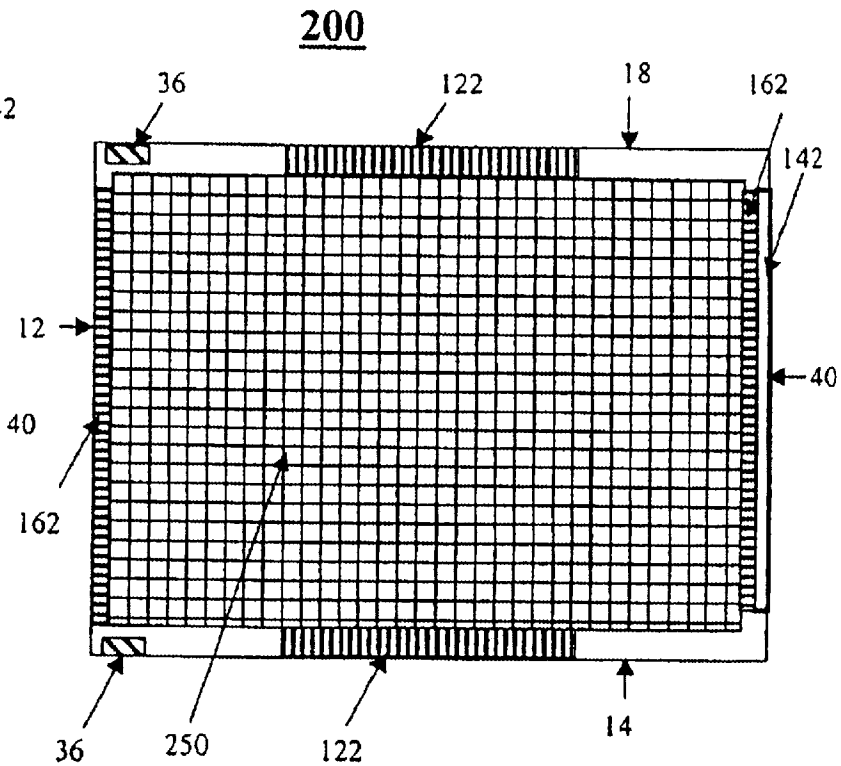
FIG. 10 is a top plan view of a top side of yet another alternative embodiment utilizing alternative fastening means and a single mesh bag in accordance with the present invention.
Figure 9:
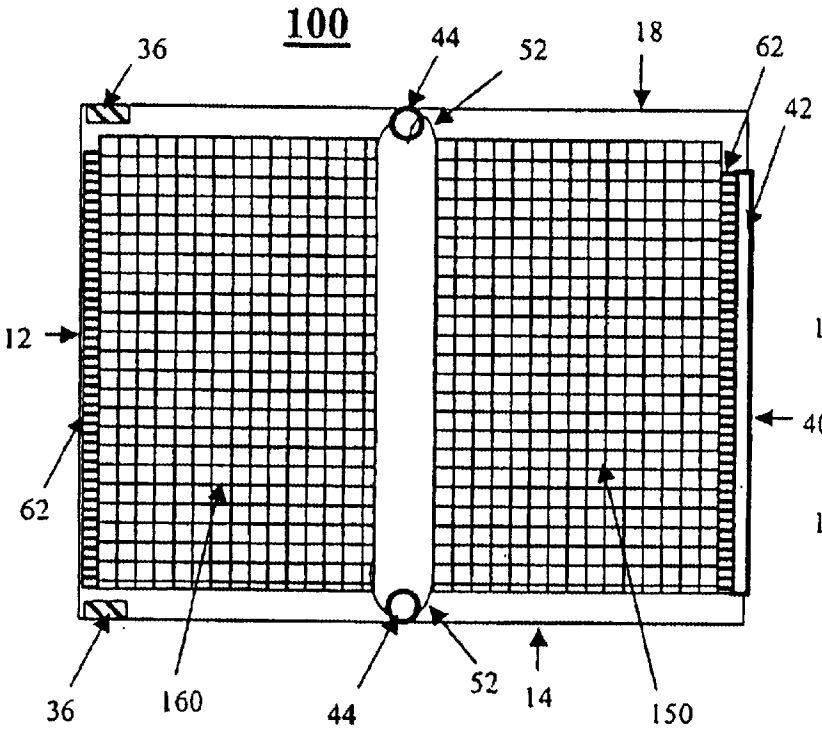
FIG. 9 is a top plan view of a top side of an alternative embodiment utilizing alternative fastening means and mesh bag arrangements in accordance with the present invention.

Referring to FIGS. 1–8, a combination travel and laundry bag 10 is illustrated. The bag preferably has a main compartment having a substantially parallelepiped shape formed within six sides (12, 14, 16, 18, 40 and 20) with a first side (12, 14, 40, or 18) that is longer and substantially orthogonal to a second side (16 or 20). The bag 10 also has an opening on the first side that is selectively closed for providing access to the main compartment as a travel bag. Preferably the opening utilizes a zipper (13 or 15) for selectively opening and closing the first side. The zipper ideally opens adjacent to three edges on the bag 10 to allow for vertical stacking of folded laundry after washing if desired. The bag 10 further comprises an opening on the second side that is selectively closed preferably using a zipper 17, wherein at least a first meshed bag (50 or 60) is selectively attached to portions of the periphery of the second side and wherein the first meshed bag hangs down when the second side serves as a top side of the combination travel and laundry bag. In addition, the zippers 13, 15, or 17 are preferably large zippers with dual sliders as shown. Ideally there are two or more meshed bags. The meshed bag is selectively attached to the periphery of the second side preferably using clasps or hooks 63 coupled to a periphery 61 of an opening of the meshed bag as shown in FIGS. 4, 5 and 6. The hooks 63 would attach to rings 44 on the interior periphery of the second side. The meshed bag or bags could alternatively be selectively attached to portions of the periphery of the second side using mating hook-and-loop fasteners (or Velcro) on the outer periphery of openings of the meshed bags and on the inner periphery of the second side as shown in FIGS. 9 and 10. It should be understood that the there could be numerous other ways of attaching the meshed bags and the present invention should not be limited to the examples shown. It should also be understood that the meshed bags stitched or affixed to the periphery of the second side are also contemplated within the scope of the present invention.

Figures 1, 2, 3:
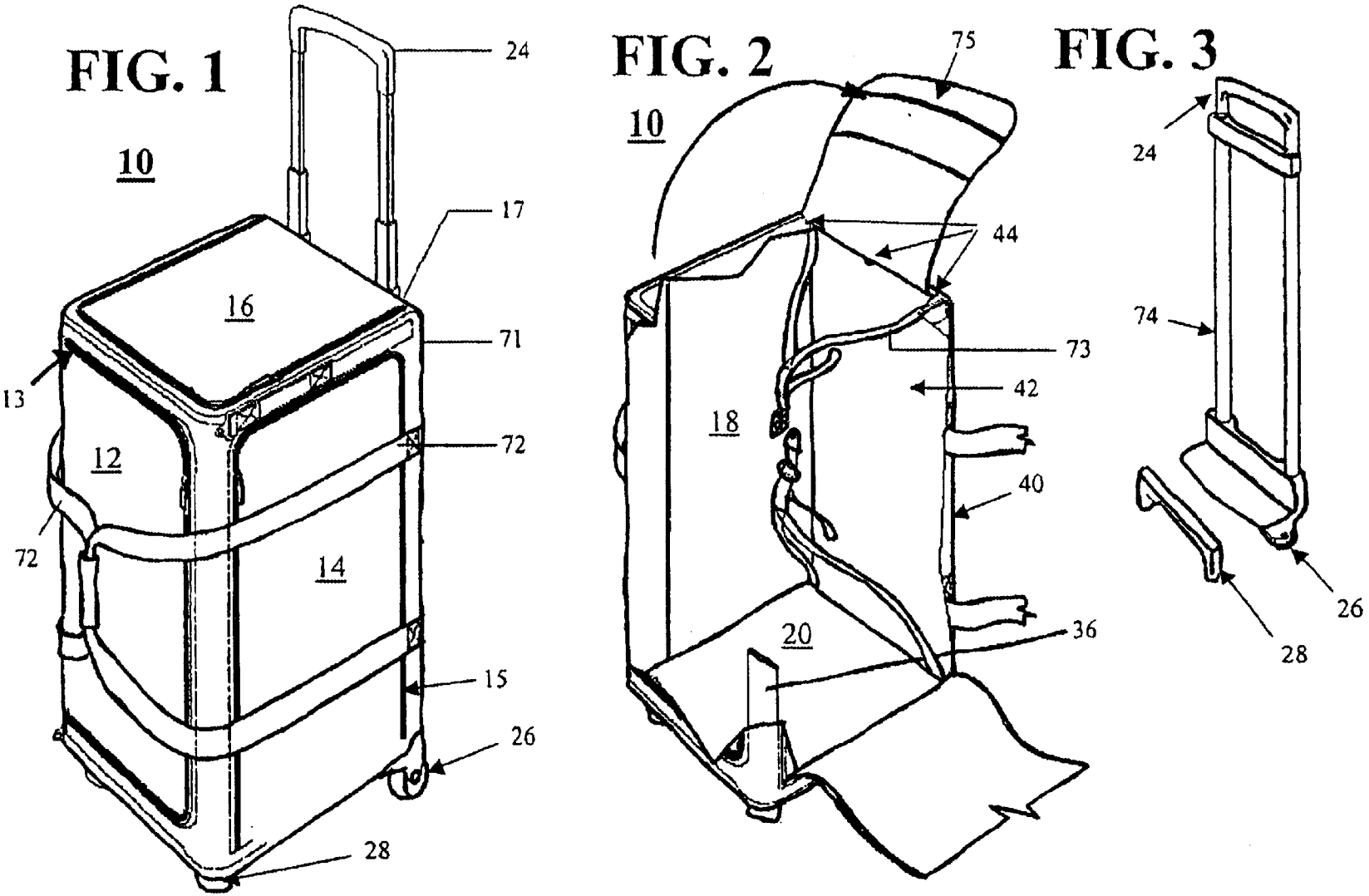
FIG. 1 is a front left perspective view of a combination travel and laundry bag in accordance with the present invention.
FIG. 2 is a cutout detail view illustrating an interior main compartment of the bag of FIG. 1 in accordance with the present invention.
FIG. 3 is a front left perspective cut-out view of a handle and wheel system used in conjunction with the combination travel and laundry bag in accordance with the present invention.

The bag 10 preferably includes other items for additional convenience and utility in travel. For example, the bag 10 can further comprise wheels 26 on an opposing side of the second side of the bag and a telescoping handle 24 that selectively rises above the second side of the bag. The telescoping handle 24 and wheels 26 could be integrated as shown in FIG. 3 utilizing vertical members 74. The vertical members 74 and frame, bracket, or wheel well could be coupled to a rear side 40 of the bag utilizing rivets for example. The bag may further include feet 28 that are preferably made of rubber to serve as a front base support, particularly when the bag sits upright or when serving as a hamper as shown. The bag 10 can also include handle or handles 72 and shoulder straps (not shown) to enable the easy loading and unloading of the bag into a trunk of a vehicle for example.

Alternatively, the combination travel and laundry bag 10 of FIGS. 1–8 can be described slightly differently to comprise a main compartment having a substantially parallelepiped shape with a top side 16, a bottom side 20, a front side 12, a rear side 40, a left side 14, and a right side 18. The bag 10 further comprises a first opening that is selectively closed preferably using a zipper for providing access to the main compartment as a travel bag on at least one side selected from the group of the front side 12, the left side 14, or the right side 18. The bag 10 also comprises an opening on the top side 16 that is selectively closed, wherein at least a first meshed bag (50 or 60) is selectively attached to portions of the periphery of the top side 16. The meshed bag is preferably made of nylon webbing, although other materials are quite suitable. The meshed bag or bags (either 50 or 60 or both) is selectively attached to the periphery of the top side 16 using clasps or hooks 63 or hook and loop fasteners or Velcro 62 or 162 (as shown in FIG. 9 or 10 respectively) or other attachment means coupled to portions of a periphery 61 of an opening of the meshed bag. The clasps or hooks 63 preferably attaches to rings 44 on the interior periphery of the top side 16. As shown in FIGS. 9 and 10, the attachment means for selectively attaching the meshed bag or bags to portions of the periphery of the top side can utilize any combination of hooks and mating hook-and-loop fasteners on the outer periphery of openings of the meshed bags and on an interior periphery of the top side and can further use any number of meshed bags and any number of orientations. For example, in a bag 100 shown in FIG. 9, meshed bags 150 and 160 are oriented in a manner somewhat orthogonal to the meshed bags 50 and 60 of FIGS. 4 and 9. The meshed bags in FIG. 9 also use a combination of Velcro and hooks. For example, the bag 100 uses Velcro 62 to attach meshed bag 160 to the front side 12 and to attach meshed bag 150 to the rear side 40 via a rear board or baseboard 42. The remaining corners of the meshed bags are coupled to the interior periphery of the bag 100 using hooks 54 that attach to rings 44 that are affixed to the bag 100. In another example, bag 200 of FIG. 10 illustrates a single meshed bag 250 that occupies a portion of the interior space in the main compartment. In this instance the meshed bag 250 is attached to the interior periphery of the top side 16 of the bag 200 using solely hook and loop fasteners or Velcro. In this instance, fasteners 122 couples right side 18 and left side 14 to corresponding sides of the meshed bag 250 while fasteners 162 couples the front side 12 and rear sides 40 to other corresponding sides of the meshed bag 250. The fastener 162 is coupled to the rear side 40 via rear board or base board 142.

Figure 7:
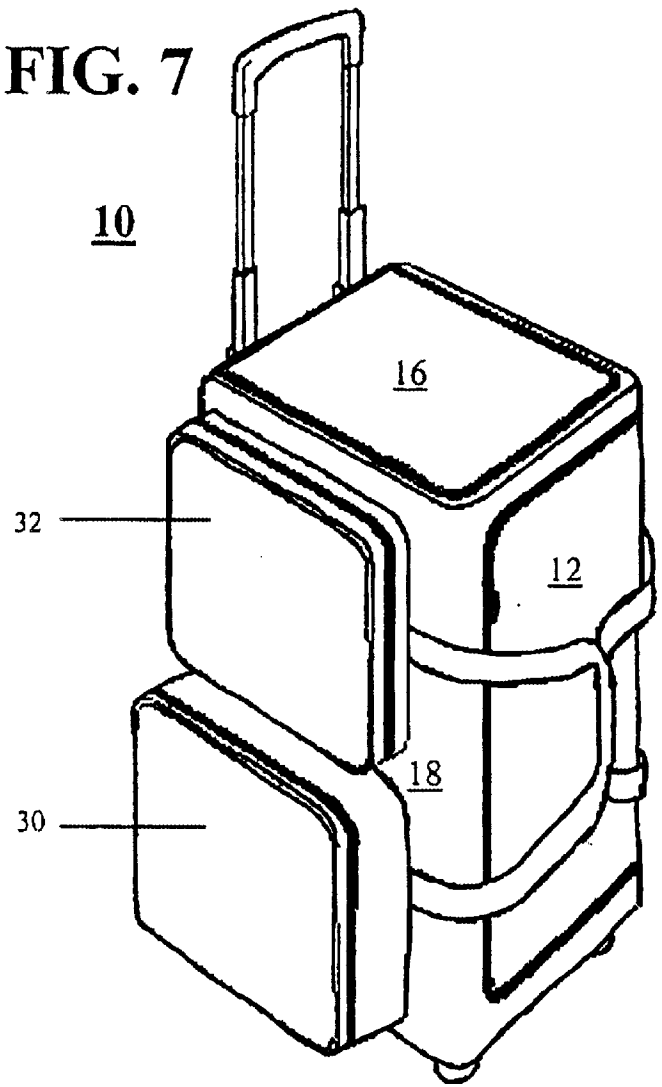
FIG. 7 is a right front perspective view of the combination travel and laundry bag in accordance with the present invention.

Other items comprising the bag 10 can include wheels 26 on the bottom side 20 of the bag and a telescoping handle that selectively rises above the top side 16 of the bag. Of course, the wheel and telescoping handle can be an integrated unit that can be attached to the bottom side 20 and/or rear side 40 of the bag. The bag 10 can further comprise removable board inserts 36 placed adjacent to the edge between the front side 12 and the left side 14 and the edge between the front side 12 and the right side 18 of the bag. The inserts 36 are preferably made of a thick honeycomb plastic that gets inserted between the fabric of the bag 10. These removable inserts are particularly useful in reducing freight cost by enabling the collapse of the bag 10 when not filled with laundry. In this manner, the manufacturer of the bag can ship a collapsed bag to customers who subsequently insert the inserts 36 to provide greater rigidity and stability to the bag 10. The removable inserts once inserted as well as board support 71 (shown in FIG. 1) provide support to the overall shape of the bag 10. Optionally, the bag 10 further comprises external compartments 30 and 32 (as seen in FIG. 7) for storage of laundry products such as detergent, fabric softener or bleach. The bag 10 may also include interior pockets for storage of at least the first meshed bag and an elastic strap 73 coupled to the rear side 40 of the bag for retention of garments once laundered and folded. The bag 10 could also include various pockets (not shown) for holding coins or other items. For example, a pocket on the top side 16 would provide convenient access to coins.

The description above is intended by way of example only and is not intended to limit the present invention in any way except as set forth in the following claims.

What is claimed is:

1. A combination travel and laundry bag, comprising:

a main compartment having a substantially parallelepiped shape with a first side that is longer and substantially orthogonal to a second side;

an opening on the first side that is selectively closed for providing access to the main compartment as a travel bag;

elastic strap coupled within the main compartment of the bag; and an opening an the second side that is selectively dosed, wherein at least a first meshed-bag is selectively attached to portions of the periphery of the second side using at least one among hooks couple to a periphery of an opening of the first meshed bag which attaches to at least one among rings on the interior periphery of the second side or mating hook-and-loop fasteners on the outer periphery of openings of the at least first meshed bag and on the interior periphery of the second side and wherein the first meshed bag hangs down when the second side serves as a top side of the combination travel and laundry bag.

2. The bag of claim 1, wherein at least the first meshed bag that is selectively attached to the periphery of the second side uses the hooks coupled to the periphery of the opening of the first meshed bag which attaches to the rings on the interior periphery of the second side.

3. The bag of claim 1, wherein the bag further comprises at least two meshed bags that are selectively attached to portions of the periphery of the second side using hooks coupled to rings on the interior periphery of the second side.

4. The bag of claim 1, wherein the bag further comprises at least two meshed bags that are selectively attached to portions of the periphery of the second side using mating hook-and-loop fasteners on the outer periphery of openings of the meshed bags and on the inner periphery of the second side.

5. The bag of claim 1, wherein the bag further comprises wheels on an opposing side of the second side of the bag.

6. The bag of claim 1, wherein the bag further comprises a telescoping handle that selectively rises above the second side of the bag.

7. The bag of claim 1, wherein the bag further comprises a telescoping handle and wheel system attached to a side of the bag.

8. The bag of claim 7, wherein the bag further comprises removable board inserts on a side opposing the telescoping handle and wheel system.

9. The bag of claim 1, wherein the bag further comprises an additional compartment external to the main compartment for storage of detergent.

10. A combination travel and laundry bag, comprising:

a main compartment having a substantially parallelepiped shape with a top side, a bottom side, a front side, a rear side, a left side, and a right side, wherein the main compartment is selectively collapsible;

a first opening that is selectively closed for providing access to the main compartment as a travel bag on at least one side selected from the group of the front side, the left side, and the right side;

an opening on the top side that is selectively closed, wherein at least a first meshed bag is selectively attached to portions of the periphery of the top side using at least one among hooks coupled to a periphery of an opening of the first meshed bag which attaches to at least one among on the interior periphery of the top side or mating hook-and-loop fasteners on the outer periphery of the openings of the meshed bags and on the interior periphery of the top side.

11. The bag of claim 10, wherein at least the meshed bag that is selectively attached to the periphery of the top side uses the hooks coupled to the periphery of the opening of the first meshed bag which attaches to the rings on the interior periphery of the top side and wherein the main compartment is able to selectively collapse and selectively return to a previous state.

12. The bag of claim 10, wherein the bag further comprises at least two meshed bags that are selectively attached to portions of the periphery of the top side using hooks coupled to rings on the interior periphery of the top side.

13. The bag of claim 10, wherein the bag further comprises at least two meshed bags that are selectively attached to portions of the periphery of the top side using mating hook-and-loop fasteners on the outer periphery of openings of the meshed bags and on the interior periphery of the top side.

14. The bag of claim 10, wherein the bag further comprise wheels the bottom side of the bag.

15. The bag of claim 10, wherein the bag further comprises a telescoping handle that selectively rises above the top side of the bag.

16. The bag of claim 10, wherein the bag further comprises a telescoping handle and wheel system attached to the bottom side and the rear side of the bag.

17. The bag of claim 16, wherein the bag further comprises removable board inserts placed adjacent to the edge between the front side and the left side and the edge between the front side end the right side of the bag.

18. The bag of claim 10, wherein the bag further comprises an additional compartment external to the main compartment for storage of detergent.

19. The bag of claim 10, wherein the bag further comprises interior pockets for storage of at least the first meshed bag.

20. The bag of claim 10, wherein the bag further comprises an elastic strap coupled to the rear side of the bag for retention of garments once laundered and folded.

* * * * *